US006921334B1

(12) United States Patent
Bennett

(10) Patent No.: US 6,921,334 B1
(45) Date of Patent: Jul. 26, 2005

(54) GAMING MACHINE

(75) Inventor: Nicholas Luke Bennett, Manly Vale (AU)

(73) Assignee: Aristocrat Leisure Industries Pty. Ltd., New South Wales (AU)

( * ) Notice: Subject to any disclaimer, the term of this patent is extended or adjusted under 35 U.S.C. 154(b) by 0 days.

(21) Appl. No.: 09/308,005

(22) PCT Filed: Nov. 10, 1997

(86) PCT No.: PCT/AU97/00759

§ 371 (c)(1),
(2), (4) Date: May 10, 1999

(87) PCT Pub. No.: WO98/20949

PCT Pub. Date: May 22, 1998

(30) Foreign Application Priority Data

Nov. 13, 1996 (AU) ..... PO3595

(51) Int. Cl.[7] ..... A63F 9/24

(52) U.S. Cl. ..... 463/16; 463/20; 463/17; 273/138.2

(58) Field of Search ..... 463/16, 13, 18, 463/19, 20, 17; 273/143 R, 138.2

(56) References Cited

U.S. PATENT DOCUMENTS 4,033,588 A * 7/1977 Watts ..... 273/138 A
4,184,683 A * 1/1980 Hooker ..... 273/143 R
4,200,291 A * 4/1980 Hooker ..... 273/143 R
4,743,024 A * 5/1988 Helm et al. ..... 273/143 R
4,756,531 A * 7/1988 Dire et al. ..... 273/138 A
4,837,728 A * 6/1989 Barrie et al. ..... 364/412
5,280,909 A 1/1994 Tracy
5,380,007 A * 1/1995 Travits et al. ..... 273/144 A
5,393,057 A * 2/1995 Marnell, II ..... 273/85
5,545,088 A * 8/1996 Kravitz et al. ..... 463/40
5,605,504 A * 2/1997 Huang ..... 463/22
5,624,119 A * 4/1997 Leake ..... 273/269
5,755,619 A * 5/1998 Matsumoto et al. ..... 463/19
5,813,911 A * 9/1998 Margolin ..... 463/19
5,890,962 A * 4/1999 Takemoto ..... 463/20
5,951,397 A * 9/1999 Dickinson ..... 463/36
5,971,849 A * 10/1999 Falciglia ..... 463/16
5,980,384 A * 11/1999 Barrie ..... 463/16
6,015,346 A * 1/2000 Bennett ..... 463/20
6,648,758 B2 * 11/2003 Bennett et al. ..... 463/20

FOREIGN PATENT DOCUMENTS

SE 9403873 2/1994

* cited by examiner

*Primary Examiner*—Minh Trinh
(74) *Attorney, Agent, or Firm*—Katten Muchin Zavis Rosenman

(57) ABSTRACT

A gaming machine for playing a lotto or bingo type game has display means, and game control means arranged to control images displayed on the display means. The game control means are arranged to play a game in which a player makes a selection, on the machine, of a series of indicia chosen from a larger group of indicia, and the game control means are arranged to generate a series of indicia drawn at random from the larger group of indicia. The display means show, in a predetermined location, those indicia which have been selected for comparison with the players selected indicia. A prize being awarded if more than a predetermined number of matches occur. It is a characteristic of the game that a plurality of games are played in parallel, with the indicia drawn at random for each game being drawn from separate groups initially corresponding to the indicia contained in the larger group of indicia, but with each game utilizing the same player selection of indicia, and in that each game has a predetermined display area on the screen area distinct from the other games. This makes the game faster and more interesting for players.

19 Claims, 8 Drawing Sheets

EXTRA 3 FREE BALL

| HITS | 3 | 4 | 5 | 6 | 7 | 8 | 9 | 10 |
|---|---|---|---|---|---|---|---|---|
| NUMBER OF SPOTS MARKED | | | | | | | | |
| 2 | | | | | | | | |
| 3 | 3 | | | | | | | |
| 4 | 19 | 10 | 4 | | | | | |
| 5 | 87.556% | 67 | 18 | 13 | 6 | | | |
| 6 | | 87.520% | 100 | 65 | 21 | 18 | 10 | 5 |
| 7 | | | 87.454% | 300 | 90 | 74 | 25 | 15 |
| 8 | | | | 87.201% | 750 | 300 | 125 | 60 |
| 9 | | | | | 87.670% | 3000 | 600 | 150 |
| 10 | | | | | | 87.741% | 5000 | 1250 |
| | | | | | | | 87.756% | 10000 |
| | | | | | | | | 87.749% |

HIT RATES

| OVERALL | 6.10 | 19.39 | 9.68 | 28.74 | 15.23 | 44.20 | 24.13 | 14.73 |
|---|---|---|---|---|---|---|---|---|

PROBABILITY OF WILDBALL = 1 CHANCE IN 9
AVERAGE PERCENTAGE = 87.581%

FIG. 9

GAMING MACHINE

BACKGROUND OF THE INVENTION

The present invention relates to gaming machines of the type generally referred to as slot machines, fruit machines, or poker machines, and in particular the invention provides a game to be played on such a machine.

DESCRIPTION OF THE PRIOR ART

Players who regularly play gaming machines, quickly tire of particular games and it is therefore necessary for manufacturers of gaming machines to come up with either innovative game features that add interest to the games provided on such machines, or provide new games in order to keep the players amused and willing to continue playing gaming machines.

Recently, the gaming machine market has experienced considerable growth and there is intense competition between manufacturers of gaming machines to supply the various existing and new venues. Clearly the revenue raised by an operator of a particular venue depends on the amount of money wagered. The amount of money wagered on a particular machine is related to the popularity of the machine. Thus when selecting a supplier of gaming machines, the operator of venue often pays close attention to the popularity of the various games with their patrons.

Therefore, gaming machine manufacturers are keen to devise games which are popular with players, as a mechanism for improving sales.

In particular, manufacturers regularly devise new games or game features which have not previously been seen on slot machines, in order to stimulate renewal of player interest.

The two most popular types of gaming machine either offer card games, particularly poker and variations of that game, or are machines of the traditional, and somewhat confusingly named, poker machine style (also known as fruit machines) in which the display means comprises a set of rotatable reels, each carrying a plurality of symbols, or a video simulation thereof.

However, even with the best efforts of game designers introducing features such as multi line plays, wild cards, and other similar features designed to stimulate player interest, the basic games have remained essentially the same. Gaming manufacturers have been unable to devise a new game which has achieved the same level of success and player interest as card machines and poker machines.

One game which is popular in clubs, although not on gaming machines is keno. In keno, a player picks a selection of numbers ranging from 1 to 80. A series of numbers is then drawn at random from the set 1 to 80. The player wins or loses depending on how many of the numbers the player selected match those which have been drawn at random.

One popular version of the game, known as "Club Keno" can be simultaneously played at a large number of venues in Australia. The venues include various clubs and hotels and are linked to a central system controlling the game by satellite or other suitable communication means. One game of keno is played every 15 minutes. Each player marks off their chosen numbers on a game card. The player then passes that game card and their stake money to a cashier at the venue, who processes their game card, enters the player for the next draw of keno and gives them a ticket showing the number of the game to be played and the numbers the player has chosen. One or more television screens in the venue shows an image of a board having the available numbers in the game, i.e. 1 to 80. The game commences and a series of numbers are drawn at random from the set 1 to 80. The television screen indicates which numbers have been drawn at random by displaying a ball showing the drawn number growing and apparently shooting outwards from the centre of the screen. The ball is then displayed at one side of the board and the particular square on the board which shows that particular number changes colour.

Keno and other bingo and lotto type games are particularly popular, because players choose their own numbers for each game, and therefore have more input into the game and consequently believe they can influence the outcome of the game if they choose the numbers correctly. However, whilst keno type games are perfectly satisfactorily as a diversion or side show in a hotel or club, those games are much too slow for use as a game for a gaming machine, and they supply insufficient excitement to persuade a person to play the game on a stand alone gaming machine. Further, because the game is slow, it does not achieve a sufficiently high turnover for use on a gaming machine.

It is an object of the present invention to alleviate the disadvantages of the prior art discussed above and to provide an improved game for a gaming machine.

SUMMARY OF THE INVENTION

The present invention consists of a gaming machine having display means, and game control means arranged to control images displayed on the display means, the game control means being arranged to play a game in which a player makes a selection, on the machine, of a series of indicia chosen from a larger group of indicia, the game control means being arranged to generate a series of indicia drawn at random from the larger group of indicia, the display means being adapted to display, in a predetermined location those indicia which have been selected for comparison with the players selected indicia, with a prize being awarded if more than a predetermined number of matches occur, characterised in that a plurality of games are played in parallel, with the indicia drawn at random for each game being drawn from separate groups initially corresponding to the indicia contained in the larger group of indicia, but with each game utilizing the same player selection of indicia, and in that each game has a predetermined display area on the screen area distinct from the other games.

Thus the present invention provides a bingo type game in which a player need only make one selection of indicia, such as numbers, but which, by playing a number of games in parallel and selecting different, potentially matching, numbers at random for each game, and displaying all the games on screen creates a game with increased player interest.

In a typical embodiment the indicia are numbers.

In a preferred embodiment, the predetermined display areas on the screen which are arranged to display the numbers generated by the game control means, are a series of columns, arranged side by side. As each separate game proceeds the display is arranged to show the series of potentially matching numbers for each game drop into the column associated with that particular game to be retained for display purposes in that column if that number corresponds to one of the numbers chosen by the player. If the number does not match the chosen numbers it is caused to disappear from the column.

In a preferred embodiment one of the two columns either side of the series of columns displays the numbers chosen by the player. The other of the two columns may display the prizes awarded for each quantity of matching machines.

Typically, all the selected numbers are displayed as a representations of numbered balls.

In a preferred embodiment, the game includes a wild ball feature in which a ball drops into the first game column adopts a value which equates with one of the numbers chosen by the player, registers in the first column, and then transfers to the next adjacent column leaving a duplicate of itself in the first column, and continues the process transferring from the, second column to the third, the third to the fourth, etc. If the wild ball lands in a column and that column already has received and retained a ball having the number adopted by the wild ball, the wild ball may change to a different one of the players preselected numbers which is not already present in that column, before transferring to the next column etc.

A further preferred feature of the game when certain prizes are awarded, or events take place, extra free balls, typically three, drop into the columns.

BRIEF DESCRIPTION OF THE DRAWINGS

A specific embodiment of the invention will now be described, by way of example only, and with reference to the accompanying drawings in which:

FIG. 9 illustrates a table showing pieces awarded for selected numbers of hits.

DETAILED DESCRIPTION OF THE PREFERRED EMBODIMENTS

Figure 1:
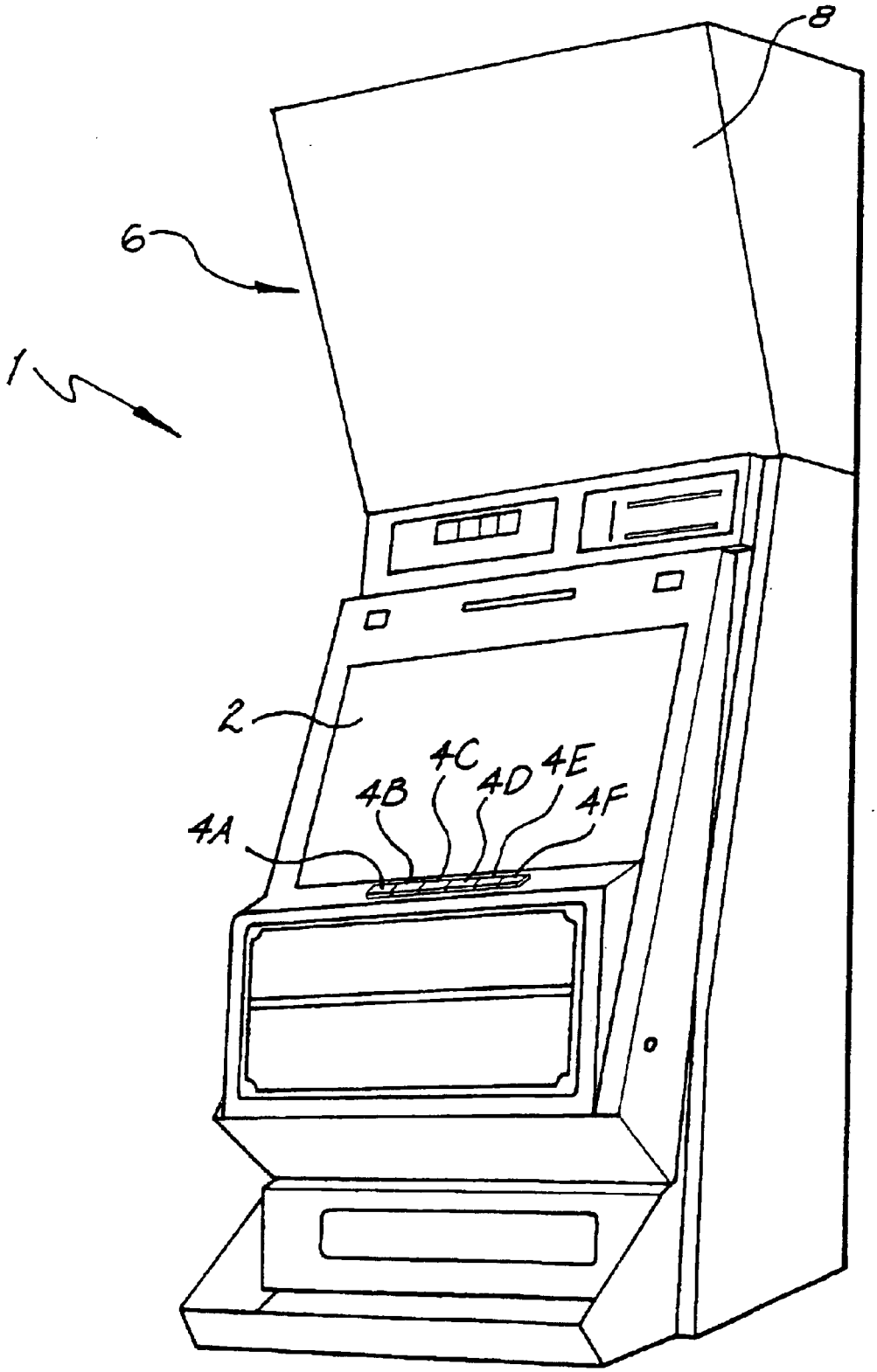
FIG. 1 shows a gaming machine having a video screen for display and playing of a game embodying the present invention.

Referring to the drawings, FIG. 1 shows a gaming machine, generally indicated at 1, adapted to play a game embodying the present invention.

The machine is of the type having a video display screen 2. The game may be initiated and controlled by one or more push buttons 4A, 4B, 4C, 4D, 4E, 4F, in conjunction with touch screen "buttons" described below. The top box 6 on top of the machine carries an artwork panel 8 which displays the various winning combinations for which a prize is paid on the machine.

In the following detailed description, the methodology of the embodiments will be described, and it is to be understood that it is within the capabilities of the non-inventive worker in the art to introduce the methodology on any standard micro-processor based gaming machine by means of appropriate programming.

Figure 2:
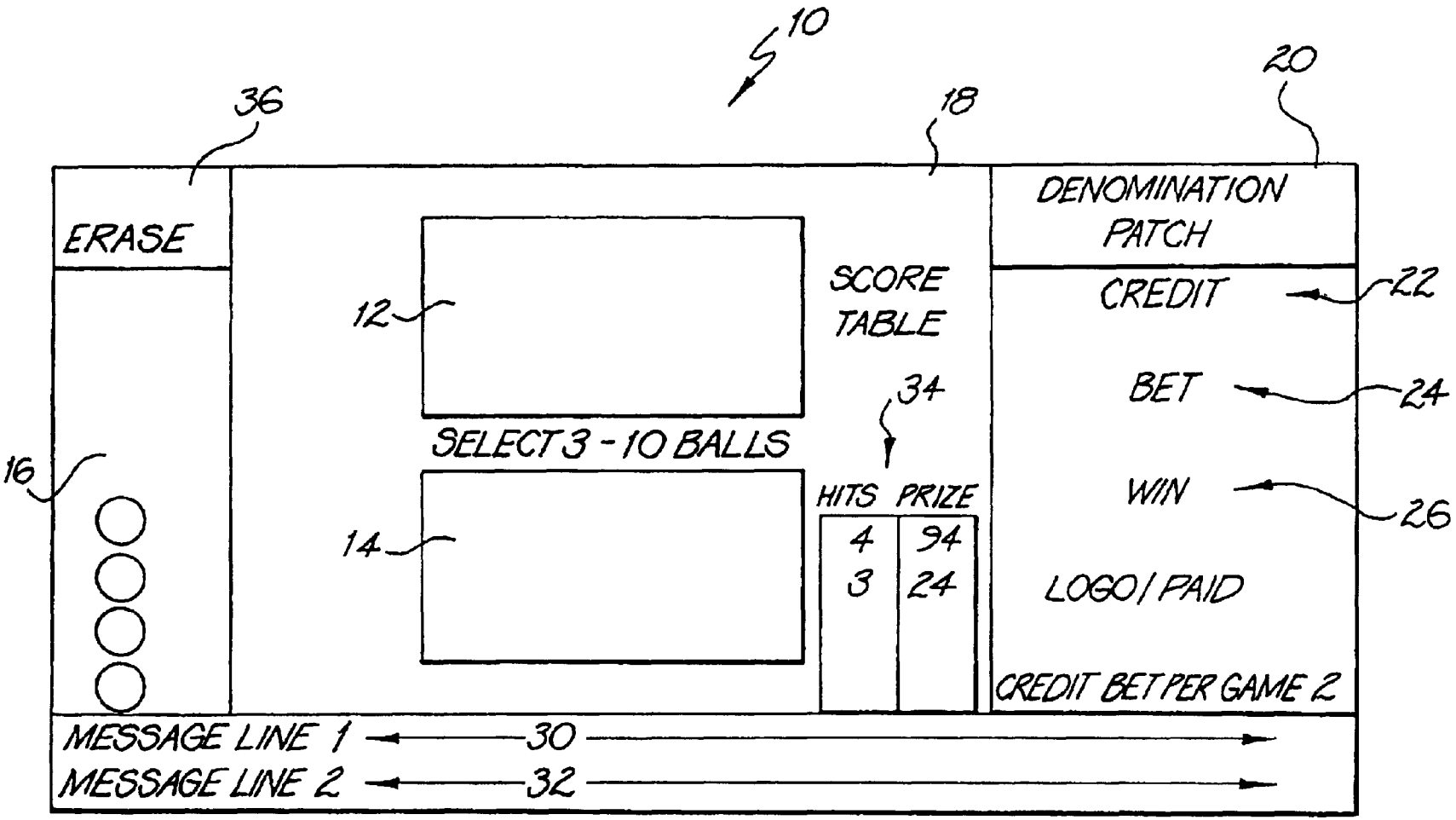
FIG. 2 shows a schematic drawing illustrating features of a first screen display of a game embodying the present invention.

FIG. 2 shows a first screen display for the game.

The first screen 10 displays 80 white balls clearly numbered 1 to 80 in two groups, (numbered 12 and 14 respectively) of 40 balls. The machine includes a touch screen feature, described later, and when a ball is touched by a player, it is transferred over to a vertical column 16 on the left hand side of the screen. The vertical column of balls is put in ascending order starting from the bottom. The prizes for the number of balls selected, credits bet per game and the number of hits is displayed on a score table generally indicated at 18. To the right of the screen at the top appears a denomination patch 20 is displayed which indicates the cost of each game which in this embodiment is 20 cents. Below the denomination patch at 22 there is an indication of the player credits available on the machine.

Below the indication of the credit available is an indication of the amount of credits bet per game at 24. In the described embodiment one, two, five or ten credits can be bet per game, but this can be varied.

Below the indication of the amount of credits bet there is, at 26, an indication of the potential win.

Across the bottom of the screen there are two message lines 30, 32 which can display various messages to the player.

The screen also displays an indication of the prize for a given number of hits at 34. In the screen shown in FIG. 1, the player has selected four balls and thus has potential wins of 94 or 24 credits if four or three hits respectively are made.

Figure 4:
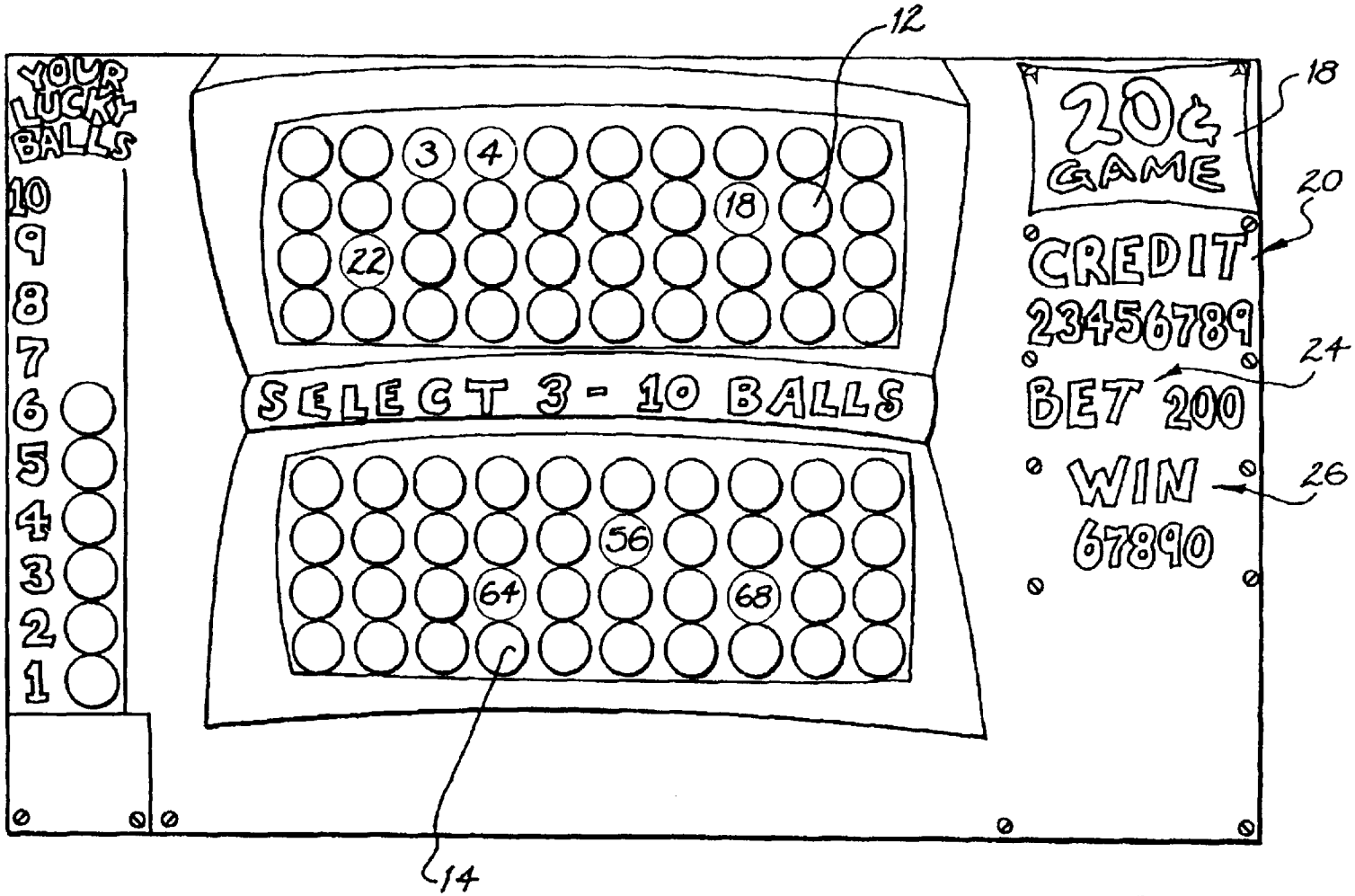
FIG. 4 shows artwork for a first screen display corresponding generally to the schematic drawing shown in FIG. 2.

FIG. 4 shows suitable artwork displaying the main features of the screen of FIG. 2.

In the described embodiment the player can play either one, three, five, eight or ten games or lines simultaneously. Since the player may bet either one, two, five or ten credits per game, this gives a maximum amount bet per round of one hundred credits if a player plays ten games/columns simultaneously, staking ten credits on each game.

After inserting credit into the machine, the player selects the number of games he or she wishes to play, and then selects between three and ten balls by touching the numbered balls on the screen in the display areas 12 and 14. The balls which are selected/touched are transferred to the column 16 at the left hand side of the screen. If a selected ball in the column 16 is touched it is returned to its group 12 or 14. If an erase button 36 is pressed all selected balls are cancelled.

Figure 3:
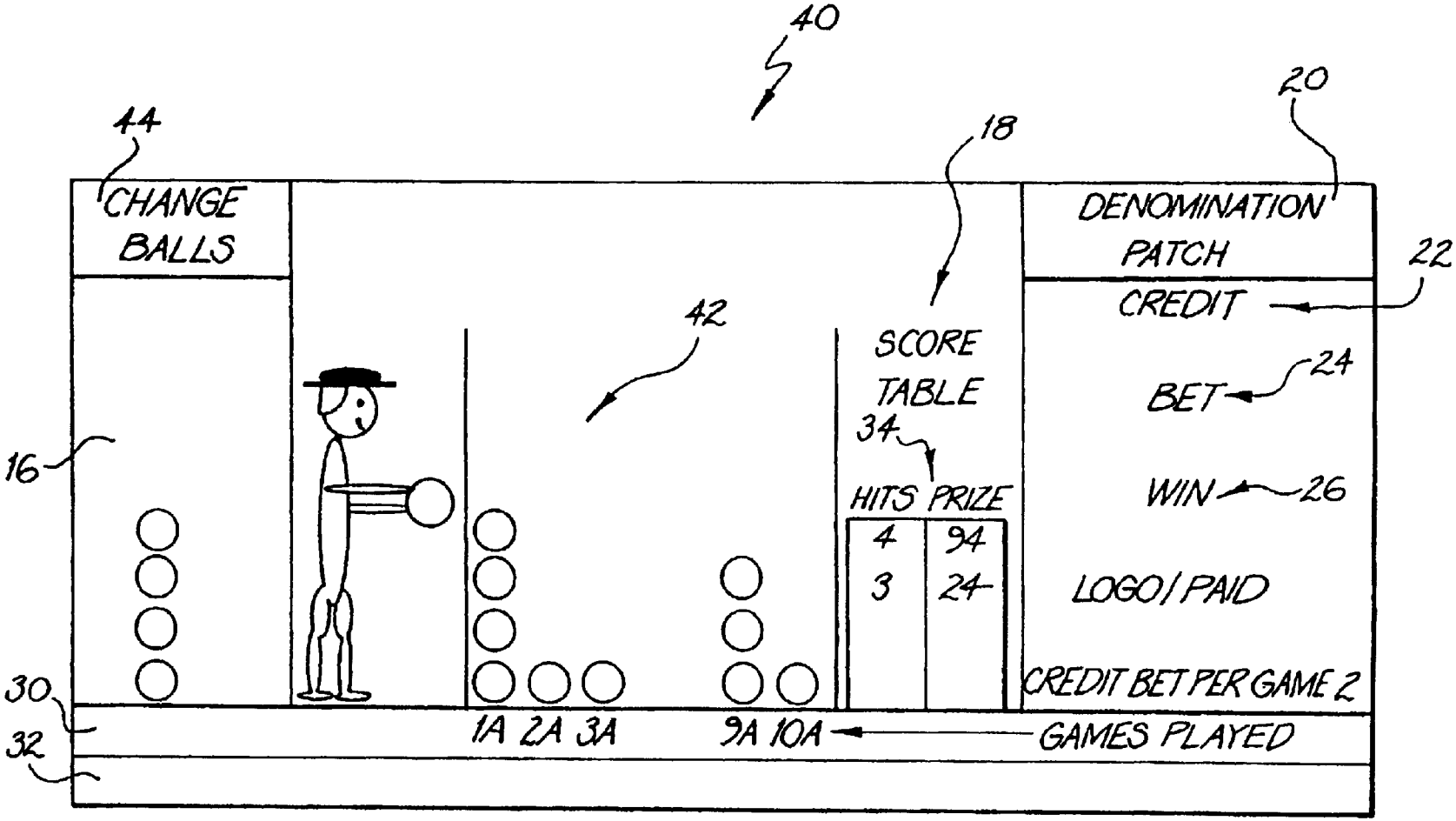
FIG. 3 shows a schematic drawing illustrating features of a second screen display of the game.

Once the player has selected their desired balls, which must be at least three in number, the player presses a play button and the screen changes to a second screen display 40, shown schematically in FIG. 3.

In this second display, a central grid 42 is shown which has ten columns, numbered 1A to 10A, to display a possible ten ball drops. (Only five of those columns are indicated in FIG. 3). Up to eleven balls can stack on top of each other in each column. The extreme left hand side of the screen displays the same column 16 of balls selected by the players as were displayed on the first screen 11. The extreme right hand side of the screen also remains the same as the first screen 10.

Figure 5:
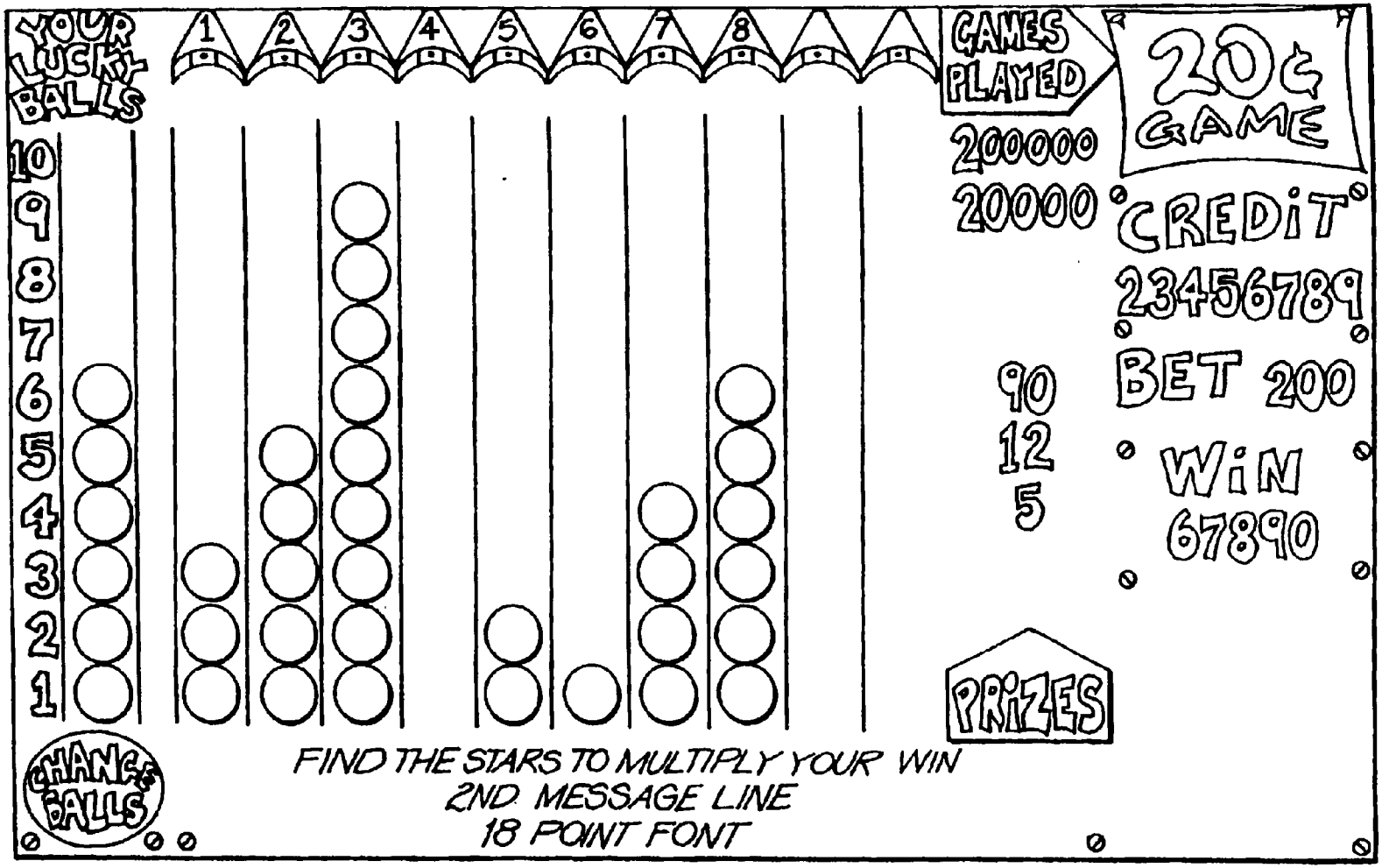
FIG. 5 shows artwork for a second screen display corresponding generally to the schematic drawing shown in FIG. 3.

As stated above, in the screen display shown in FIG. 3, to save space, only five of the columns are displayed. FIG. 5 shows an embodiment of artwork for the second screen displaying all ten columns. In that embodiment, because only eight games or columns have a stake on them, columns nine and ten are darkened. The "erase" button 36, changes to a "change balls" "button" 44.

The machine then randomly drops ten lots of twenty numbered balls from one to eighty, including a possible wild ball into the columns. The games are independent so that the numbers dropped for one game/column do not influence the numbers selected to be dropped into another column. Numbers may drop into the columns simultaneously i.e one number drops into each column at the same time, or alternatively, the numbers may drop in sequence, one column after another, although the sequence is desirably fast to retain the player interest. All ten games have a twenty ball drop irrespective of whether the games have a stake on them or not.

The score table 18 from the right of the previous screen is carried over to the second screen. The score table instantaneously updates if credits bet per game is change. The game is played on this second screen 40 until the player wishes to change their selected balls or the player runs out of credits.

Pressing the change balls button (which may be a physical button or a touch screen "button" 44 such as is shown in FIG. 5) returns the game to the first screen display 11, to enable a fresh selection of balls to be made.

The game includes a "wildball" feature in which a ball drops into the first game column 1A, adopts a value which equates with one of the numbers chosen by the player, registers in the first column 1A and then transfers to the next adjacent column 2A leaving a duplicate of itself in the first column and continues the process, transferring from the second column 2A to the third column 3A the third to the fourth etc. If the wildball lands in a column and that column already has received and retained a ball having the number adopted by the wildball, the wildball may change to a different one of the players preselected numbers which is not already present in that particular column before transferring to the next column. The wildball may of course first appear in a column other than the first column 1A say for example the third column 3A in which case it will just travel to the fourth to the tenth columns. The wildball will also double the prize for any win.

A second preferred feature of the game is a free balls feature. Pressing the "free balls" button when the shaded prize has been won (see FIG. 9 discussed below), drops an extra three free balls in each of columns 1A to 10A.

When either the wildball appears or the extra free balls feature occurs, congratulatory sounds are produced by the machine.

FIG. 9 is a table showing the prizes awarded for selected numbers of hits when between 3–10 balls ("number of spots marked") have been selected. The table illustrates the credits awarded for various numbers of matches depending on how many balls were initially selected by the player. For example, if a player selected the minimum three balls and two matches occurred in one of the columns, 3 credits are awarded for that column. If 7 balls are selected, prizes are awarded for between 4 and 7 matches. The prizes are 6 credits for 4 matches and 750 credits for 7 matches. If a number of matches between the lowest number of matches for which a prize is awarded and the maximum number of matches occurs the extra 3 free balls feature occurs. The "free ball" matches are shaded in FIG. 9. So for example, for the case where 7 balls are selected, if 5 or 6 matches occur, the 3 free balls feature occurs potentially improving the number of matches and the players winnings.

The player wins or loses depending on the number of matches made in each game, i.e. the number of balls retained in a column 1A to 10A corresponding to the numbers picked by the player. Thus for example in the screen shown in FIG. 3 where the player has selected four balls, and paid for all the columns prizes are paid for column 1A where four balls matching all four of the selected balls wins a prize of ninety-four credits, and for column 9A in which three of the balls matched the players selected four balls and a win of twenty-four credits is paid. Columns 2, 3 and 10 have only a single ball matching the players selected balls for which a prize is not awarded.

Clearly the manner of awarding prizes to a player the number of matches required for a win, the number of wild balls, the frequency of the free balls feature, is calculated so that an average, the game will provide an appropriate rate of return as required by the regulations to the player, and also provide a profit to the gaming machine operator. For example, the credits awarded in the game shown in FIG. 9 differ from those offered in the game illustrated in FIG. 3.

Figure 7:
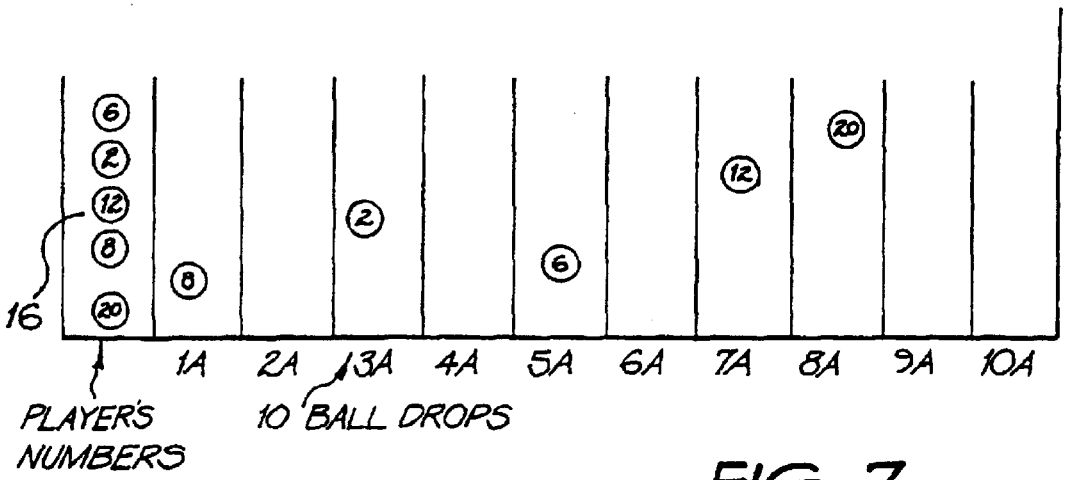
FIG. 7 illustrates a further preferred feature of the game.

A further particular feature of the game a "scatter prize" is illustrated in FIG. 7 in which the player has selected five numbers 6, 2, 12, 8 and 20. If those five selected numbers appear anywhere in any of the ten columns 1A to 10A a bonus prize is paid. In FIG. 7, number 8 appears in column 1A, number 2 in column 3A, number 6 in column 5A, number 12 in column 7A and number 20 in column 8A. Since all the player's five numbers appear in the columns, a bonus prize is paid.

Figure 6:
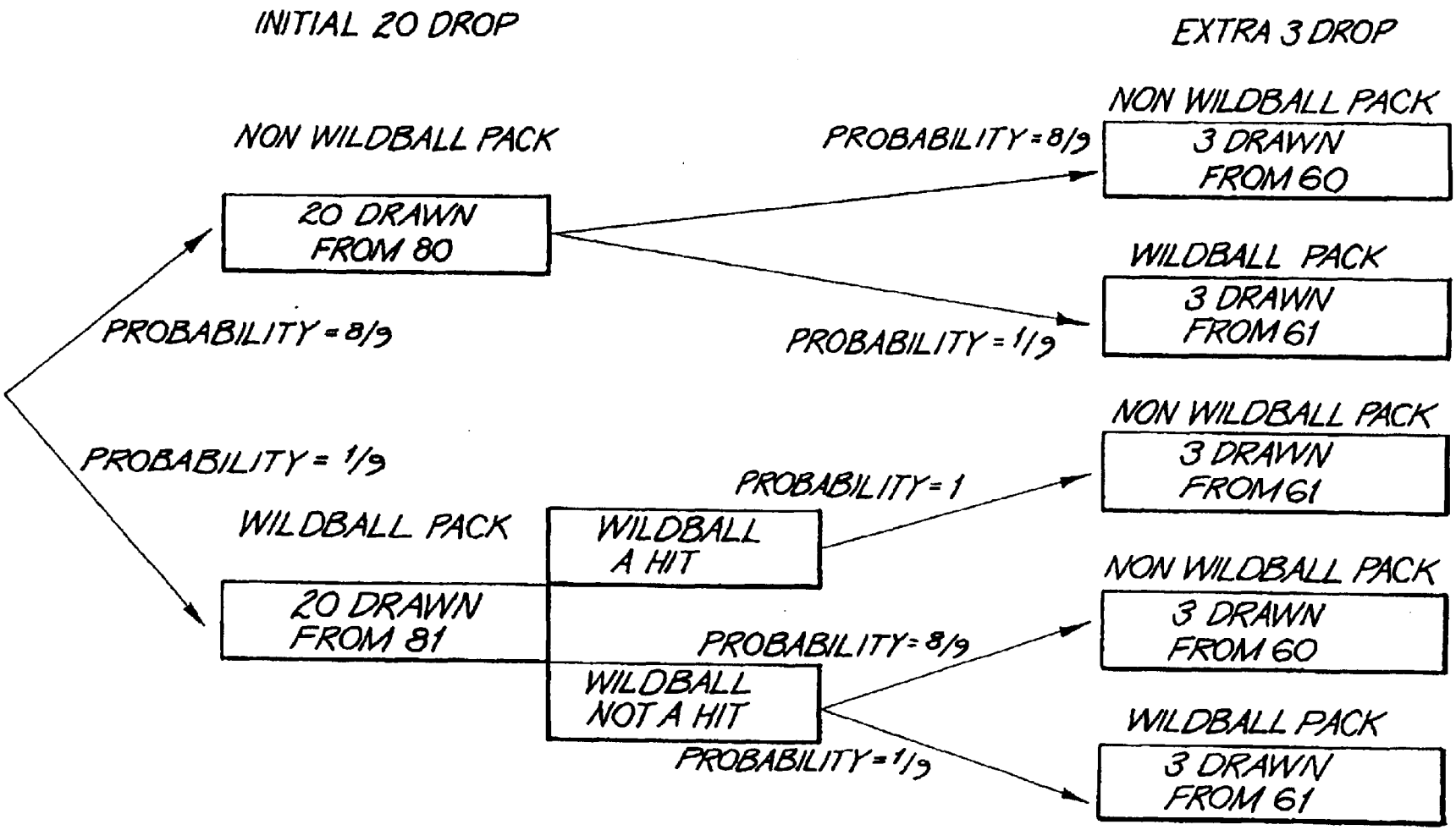
FIG. 6 shows probability diagram relating to particular preferred feature of the game.

FIG. 6 illustrates probability diagrams relating to the wildball and the free ball drop of three extra balls.

Figure 8:
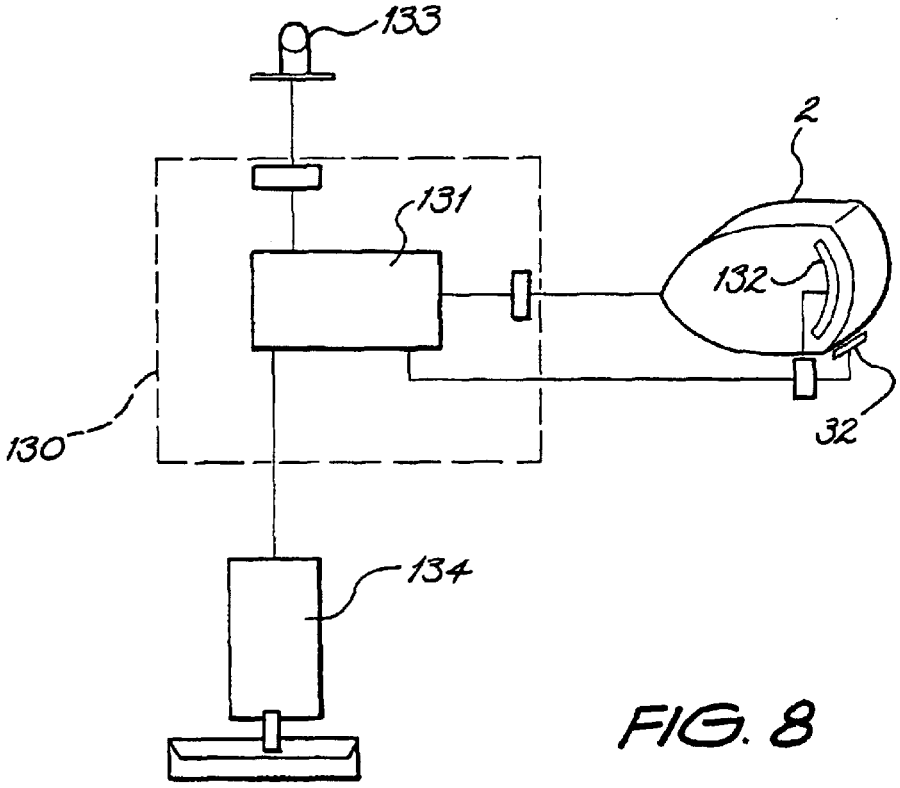
FIG. 8 is a schematic drawing of a touch screen feature of the gaming machine.

The program to implement the game runs on a standard gaming machine control processor 131 as illustrated schematically if FIG. 8. This processor forms part of a controller 130 which drives the display screen 2 and receives touch input signals from touch sensors 132 as well as receiving coin input pulses from a coin chute 133 and driving a coin payout mechanism 134.

Some of the particular features of the game are summarised below, including exemplary messages to be displayed on the message lines 30, 32.

Player Messages

Messages for the "Selection of balls" screen 11.

Scenario 1 - idle mode no credit
GAME OVER INSERT CREDIT
Scenario 2 - after credit inserted.
Touch balls to select
Scenario 3 - after X (X >= 3) spots have been selected.
PLAY NOW or Select balls
Scenario 4 - after 10 spots have been selected.
PLAY NOW or Change balls
Balls can only be selected after credits have been inserted.
Balls can only be selected in the "Selection of balls" screen.
After 10 balls are selected the other balls are "locked out" and no other balls can be selected unless at least one of the current selections has been cancelled.
After a "PLAY X GAMES" button is pressed the game goes to the "Multigame balldrop" screen (FIGS. 3.5) (pausing for approximately 2 seconds) and the 20 ball drop occurs (taking approximately 5 seconds).
When playing a "PLAY X GAMES" button is pressed and the game is already in the "Multigame balldrop" screen. the 20 balls drop in 5 seconds. The extra 3 balls drop at a lower speed.

Messages for the "Multi balldrop" screen 40

Scenario 5 - after a game has been played with no wins.
GAME OVER PLAY NOW
Scenario 6 - when the current bet can not be repeated on at least one game.

-continued

| Player Messages |
|---|
| Insert more credit or change bet. |
| Scenario 7 - zero credit after playing a game. |
| GAME OVER INSERT CREDIT |
| When a game is in zero credit for more than 2 minutes (without a "RESERVE" button pressed) the game returns to the "Selection of balls" screen and erases all current balls selected. |
| Scenario 8 - after a win (but no free balls won). |
| PLAY ON, GAMBLE or TAKE WIN |
| Pressing "Change balls" will take the win and return the game to the "Selection balls" screen. |
| Scenario 9 - after a win with free balls won. |
| Random comment |
| I like your style |
| Congratulations! Press "FREE BALLS" |
| Scenario 10 - after a win with "GAMBLE" selected. This puts the game into a "Choose odds" gamble screen. |
| I'm impressed |
| Touch ×2, ×3, ×4, ×5 or "TAKE WIN" |
| Pressing "CHANGE BALLS" will take the win and return the game to the "Selection of balls" screen 11. |
| Scenario 11 - after an incorrect selection in gamble. |
| Gamble completed |
| GAME OVER PLAY NOW |
| Scenario 12 - after a win when "TAKE WIN" is selected. |
| GAME OVER PLAY NOW |
| Scenario 13 - after a wind and "CHANGE BALLS" selected. The game returns to the "Selection of balls" screen 11. |
| PLAY NOW or Select balls |
| If 10 balls were currently selected the message would be PLAY NOW or Change balls. |
| Scenario 14 - "ERASE" selected in the "Selection of balls" screen. |
| Touch balls to select |
| OR |
| Scenario 15 - Two of the original 10 selected balls are touched. There would now be 8 balls displayed on the left had side vertical column. |
| PLAY NOW or Select balls |
| Scenario 14 will result in 80 balls being available for selection (no balls selected in vertical left hand column). |
| Scenario 15 will result in 8 balls being selected in the vertical left hand column. |

Reserve Screen

To save memory the new reserved banner is to be used on the "Selection of balls" and "Multi balldrop" screens.

Thus the described embodiment of the present invention enables a player to play a number of keno or bingo type games simultaneously, but in which the player only has to make one selection of a series of numbers and which are large number up to ten games can be played in parallel at the same time, with each game being different because different numbers are being dropped into each game column. Thus the game can be made more exciting and faster moving than a single game of keno and each parallel game will typically have a different result.

What is claimed is:

1. A gaming machine comprising a display means and a game control means arranged to control images displayed on the display means, the game control means further being arranged to play a game in which a player makes a selection of a series of indicia chosen from a larger group of indicia, that selection defining the player's selected indicia, the game control means being arranged to generate a series of indicia drawn at random from the larger group of indicia, the display means being adapted to display, in a predetermined location, the series of indicia which have been generated by the game control means for comparison with the player's selected indicia, with a prize being awarded if more than a predetermined number of matches occur between the player's selected indicia and the generated indicia, wherein a plurality of games are played simultaneously, with the indicia drawn at random for each game from separate groups initially corresponding to the indicia contained in the larger group of indicia, but wherein each game utilizes the same player's selected indicia, and wherein each game has a predetermined display area on the screen area distinct from the other games.

2. The gaming machine as claimed in claim 1, wherein the indicia are numbers and the predetermined display areas on the display means which are arranged to display the indicia generated by the game control means, are a series of columns, arranged side by side and wherein, as each separate game proceeds, the display is arranged to show the series of generated numbers for each game which are potentially matching with the player's selected numbers, drop into the column associated with that particular game to be retained for display purposes in that column if that number corresponds to one of numbers chosen by the player and wherein if the number does not match the chosen numbers, the number is caused to disappear from the column.

3. The gaming machine as claimed in claim 2, wherein one of the two columns either side of the series of columns displays the numbers chosen by the player.

4. The gaming machine as claimed in claim 3, wherein the other of the two columns displays prizes awarded for each number of matching indicia.

5. The gaming machine as claimed in claim 2, wherein the selected numbers are displayed as representations of numbered balls.

6. The gaming machine as claimed in claim 5, wherein the game includes a free ball feature in which a number of extra balls are generated on the occurrence of a predetermined number of balls in a column matching the player's selected numbers.

7. The gaming machine as claimed in claim 5, wherein a prize is awarded if all the numbers selected by the player appear distributed anywhere in the game columns being played.

8. The gaming machine as claimed in claim 1, wherein the game includes a wild indicia in which the wild indicia drops into a first predetermined display area matches one of the indicia chosen by the player, registers in the first predetermined display area, and then transfers to a second predetermined display area, adjacent to the first predetermined area, leaving a duplicate of itself in the first predetermined display area, and then transfers from the second predetermined display area to a next adjacent third predetermined display area and continues in the same manner from area to adjacent area in sequence until the wild indicia has transferred to all the predetermined display areas, wherein if the wild indicia lands in a predetermined display area which has already received and retained an indicia which is identical to the wild indicia, the wild indicia changes to a different one of the players selected indicia which is not already present in that predetermined display area, before transferring to the next adjacent predetermined display area.

9. A gaming machine comprising a display means and a game control means arranged to control images displayed on the display means, the game control means being arranged to play a game in which a player enters a selection of a series of numbers chosen from a larger group of numbers on the machine, the selection comprising the player's selected numbers, the game control means further being arranged to generate a series of numbers drawn at random from the larger group of numbers, the display means being adapted to display in a predetermined location the series of numbers which have been generated at random by the game control means, for comparison with the player's selected numbers, with a prize being awarded if more than a predetermined number of matches occur between the generated numbers and the player's selected numbers, wherein a plurality of games are played in parallel with the numbers drawn at random for each game from separate groups initially corresponding to the numbers contained in the larger group of numbers, but wherein each game of the plurality of games utilizes the same player selection of numbers, and wherein each game has a predetermined display area on the screen area distinct from the predetermined display areas of the other games on the screen which are arranged to display the numbers generated by the game control means, the predetermined display areas comprising a series of columns arranged side by side, and wherein as each separate game proceeds, the display shows the series of generated numbers for each game drop into the column associated with that game to be retained for display purposes in that column if that number corresponds to one of the player's selected numbers and wherein if the number does not match any of the player's selected numbers, the number is caused to disappear from the column.

10. The gaming machine as claimed in claim 9, wherein the numbers are displayed as representations of numbered balls and the game includes a wild ball feature in which a ball drops into the first game column adopts a value which equates with one of the numbers chosen by the player, registers in the first column, and then transfers to a second column, leaving a duplicate of itself in the first column, transfers from the second column to a third column, leaving a duplicate of itself in the second column and continues moving from column to column until all the columns have been visited by the wild ball.

11. The gaming machine as claimed in claim 10, wherein if the wild ball lands in a column and column has already received and retained a ball having the number adopted by the wild ball, the wild ball changes to a different one of the players selected numbers which is not already present in that column, before transferring to the next column.

12. The gaming machine as claimed in claim 11, wherein a prize is awarded if all the numbers by the player appear distributed anywhere in the columns being played.

13. The gaming machine as claimed in claim 12, wherein the gaming machine includes a free feature in which a number of extra balls are generated on the occurrence of a predetermined number of balls in a column matching the player's selected numbers.

14. A gaming apparatus comprising a display means and a game control means arranged to images displayed on the display means, the game control means being arranged to play a game in which a player makes a selection of a series of indicia chosen from a larger group of indicia on the machine, the selection defining the player's selected indicia, the game control means further being arranged to generate a series of indicia drawn at random from the larger group of indicia, the display means being adapted to display, in a predetermined location, those indicia which have been generated by the game control means for comparison with the player's selected indicia, with a prize being awarded if more than a predetermined number of matches of the player's selected indicia with the indicia generated by the game control means occur, wherein a plurality of parallel games are played simultaneously, with the indicia drawn at random for each game from separate groups initially corresponding to the indicia contained in the larger group of indicia, but wherein each game utilizes the same player's selected indicia and wherein each game has a predetermined display area on the screen area distinct from the other games.

15. The gaming apparatus as claimed in claim 14, wherein the indicia comprises representations numbered balls and the game includes a free ball feature in which a number of extra balls are generated on the occurrence of a predetermined number of balls in a column matching the player's selected numbers.

16. The gaming apparatus as claimed in claim 14, wherein a prize is awarded if all the indicia by the player appear distributed anywhere in the game columns being played.

17. The gaming apparatus as claimed in claim 14, wherein the predetermined display areas on screen which are arranged to display the numbers generated by the game control means, are a series of columns, arranged side by side and wherein as each separate game proceeds, the display is arranged to show the series of potentially matching numbers for each game drop into the column associated with that particular game to be retained for display purposes in that column if that number corresponds to one of the numbers chosen by the player and wherein if the number does not match the chosen numbers, the number is caused to disappear from the column.

18. The gaming apparatus as claimed in claim 17, wherein the columns define the number of games which may be played simultaneously and the player may make a selection on the machine to choose the number of columns which are to be played in parallel.

19. The gaming machine as claimed in claim 14, wherein the predetermined area define the number of games which may be played simultaneously and the player may make a selection on the machine to choose the number of areas and thus games which are to be played simultaneously.

* * * * *